US007439913B2

(12) United States Patent
Chang et al.

(10) Patent No.: US 7,439,913 B2
(45) Date of Patent: Oct. 21, 2008

(54) MICROSTRIP REFLECTARRAY ANTENNA

(75) Inventors: The-Nan Chang, Taipei (TW); Chung-Sung Chu, Taipei (TW)

(73) Assignee: Tatung Company, Taipei (TW)

( * ) Notice: Subject to any disclaimer, the term of this patent is extended or adjusted under 35 U.S.C. 154(b) by 1 day.

(21) Appl. No.: 11/636,488

(22) Filed: Dec. 11, 2006

(65) Prior Publication Data

US 2008/0024368 A1 Jan. 31, 2008

(30) Foreign Application Priority Data

Jul. 28, 2006 (TW) ..... 95127886 A

(51) Int. Cl.
*H01Q 1/38* (2006.01)

(52) U.S. Cl. ..... 343/700 MS; 343/754

(58) Field of Classification Search ..... 343/700 MS, 343/754, 755, 840, 775, 778, 779
See application file for complete search history.

(56) References Cited

U.S. PATENT DOCUMENTS 6,081,234 A * 6/2000 Huang et al. ..... 343/700 MS
6,081,235 A * 6/2000 Romanofsky et al. . 343/700 MS
6,384,787 B1 * 5/2002 Kim et al. ..... 343/700 MS
6,992,630 B2 * 1/2006 Parsche ..... 343/700 MS
7,161,539 B2 * 1/2007 Chang et al. ..... 343/700 MS
7,259,721 B2 * 8/2007 Chang et al. ..... 343/700 MS

OTHER PUBLICATIONS

N. Misran et al, Design Optimisation of Ring Elements for Broadband Reflectarray Antennas, IEE Proc.-Microw. Antennas Propag., vol. 150, No. 6, Dec. 2003.

* cited by examiner

*Primary Examiner*—Hoang V Nguyen
(74) *Attorney, Agent, or Firm*—Bacon & Thomas, PLLC

(57) ABSTRACT

A microstrip reflectarray antenna with a low cross polarization level is disclosed. The microstrip reflectarray antenna of the present invention comprises: a ground plate; a reflecting plate with an upper surface, and a plurality of microstrip antenna units locating on the upper surface; each of the microstrip antenna units consisting of an inner ring and an outer ring; a plurality of supporting units for supporting the reflecting plate above the ground plate; and a signal transmitting unit locating above the reflecting plate for transmitting and receiving the high frequency signal. Besides, the size of the outer ring corresponds to its location on the upper surface of the reflecting plate, and there is a predetermined ratio between the diameter of the outer ring and the diameter of the inner ring, and both of the outer ring and the inner ring respectively have at least one slot.

17 Claims, 9 Drawing Sheets

MICROSTRIP REFLECTARRAY ANTENNA

BACKGROUND OF THE INVENTION

1. Field of the Invention

The present invention relates to a microstrip reflectarray antenna and, more particularly, to a microstrip reflectarray antenna with lower cross polarization level for operation in a satellite communication system.

2. Description of Related Art

In a conventional satellite communication system such as satellite TV, the available operation frequency range of the channel signal transmission is highly restricted by the absorption of the atmosphere or other related factors. Currently, as the number of the channels to transmit channel signals increases significantly, i.e. hundreds of cable TV channels, the conventional satellite communication system, which uses different frequencies to transmit different channel signals (i.e. frequency multiplexing method), is no longer sufficient for operation. As a result, another conventional satellite communication system, which uses a plurality of same frequency signals having different polarization directions to transmit different channel signals, is then proposed. By using this satellite communication system employing the frequency multiplex method, the channels available for transmitting the channel signals can be increased significantly. As a result, there is not immediate need to launch new satellites, which results in saving a huge amount of money.

As described above, in the aforesaid frequency multiplex method, several channel signals share the same channel to transmit and receive by the antenna. Thus, if the antenna of the conventional satellite communication system cannot clearly recognize the polarization direction of the channel signal it is designated to receive and filter out the channel signals with other polarization directions, the antenna of the conventional satellite communication system may receive two or more channel signals at the same time. Although the strength of the channel signal (target signal) is higher than the other channel signals (noise signals), the reception of the target signal will still be influenced by the noise signals. FIG. 1A shows a schematic diagram of the microstrip reflectarray antenna of the prior art. The microstrip reflectarray antenna of the prior art comprises a ground plate 11, a reflecting plate 12, four supporting units 13 and a horn antenna 14. The reflecting plate 12 is supported by the four supporting units 13 being composed of the insulating materials, and thus a predetermined distance between the reflecting plate 12 and the ground plate 11 being composed of copper is maintained. Besides, the microstrip reflectarray antenna of the prior art further comprises a plurality of microstrip antenna units 15 locating on the upper surface 121 of the reflecting plate 12. Each of the microstrip antenna units 15 comprises an inner ring 151 and an outer ring 152. Furthermore, the size of each of the microstrip antenna units 15 corresponds to its location on the upper surface 121 of the reflecting plate 12. Moreover, these microstrip antenna units 15 of the microstrip reflectarray antenna of the prior art further comprise some characteristics as described as below:

1. There is a predetermined ratio relationship between the length of the second diameter of the inner ring 151 and the length of the first diameter of the outer ring 152 of the same microstrip antenna unit 15.

2. Both the outer ring 152 and the inner ring 152 of the same microstrip antenna units 15 have the same width (4 mm).

FIG. 1B shows a schematic diagram of the IE3D software simulation result of the plane wave scattering field of the microstrip reflectarray antenna of the prior art. As shown in the figure, the cross polarization level (XPL) of the microstrip reflectarray antenna of the prior art is remarkably high. Therefore, when the microstrip reflectarray antenna of the prior art is designated to receive a high frequency signal with Y-polarization direction, the microstrip reflectarray antenna of the prior art can still receive some high frequency signals with X-polarization direction at the same time, with the noise degenerating the reception of the high frequency signal with Y-polarization direction.

Therefore, a microstrip reflectarray antenna which can receive a high frequency signal with single polarization direction, such as a microstrip reflectarray antenna with lower cross polarization level, is required in the field, so as to increase the reception quality and the number of available channels of a satellite communication system.

SUMMARY OF THE INVENTION

The present invention relates to a microstrip reflectarray antenna for transmitting and receiving a high frequency signal, comprising: a ground plate; a reflecting plate with an upper surface and a plurality of microstrip antenna units locating on the upper surface; each of the microstrip antenna units consisting of an inner ring and an outer ring; a plurality of supporting units for supporting the reflecting plate above the ground plate, so as to maintain a predetermined distance between the reflecting plate and the ground plate; and a signal transmitting unit locating above the reflecting plate for transmitting and receiving the high frequency signal; wherein, the size of the outer ring corresponds to the location of the outer ring on the upper surface of the reflecting plate; each the microstrip antenna units comprises an outer ring with a first diameter and an inner ring with a second diameter, and there is a first ratio relationship between the first diameter of the outer ring and the second diameter of the inner ring of the same microstrip antenna unit; each of the outer rings has at least one first slot, and each of the inner rings has at least one second slot.

Therefore, as each microstrip antenna unit of the microstrip reflectarray antenna of the present invention consists of an outer ring having two first slots, and an inner ring having two second slots, wherein the connecting line connecting the two first slots (not shown in the figure) is parallel to the other connecting line connecting the two second slots (not shown in the figure), the microstrip antenna units of the microstrip reflectarray antenna of the present invention can prevent the current induced by a high frequency signal having a polarization direction perpendicular to the connecting line of the two first slots from flowing on the microstrip antenna units when the microstrip reflectarray antenna of the present invention is in its "receiving state". As a result, the microstrip reflectarray antenna of the present invention can only receive the high frequency signals having the polarization direction parallel to the connecting line of the two first slots of the microstrip antenna units, and the cross polarization level of the microstrip reflectarray antenna is further reduced. Hence, by using the microstrip reflectarray antenna of the present invention, a satellite communication system can use one frequency channel to transmit two or more signals with different polarization directions at the same time. Thus, the capacity of the satellite communication system is enlarged, and the reception quality thereof is also improved.

The microstrip reflectarray antenna of the present invention can use any kind of the signal transmitting unit, preferably the signal transmitting unit is a horn antenna. The microstrip reflectarray antenna of the present invention can receive or transmit the high frequency signal in any frequency range, preferably, the frequency of the high frequency signal is in the range of 9 GHz and 12 GHz. The microstrip reflectarray antenna of the present invention can comprise a ground plate composed of any kind of material, preferably the ground plate is composed of a material such as copper, aluminum, or gold. The microstrip reflectarray antenna of the present invention can comprise a reflecting plate composed of any kind of material, preferably the reflecting plate is composed of a material such as an FR-4 microwave substrate, a Duroid microwave substrate, a Teflon microwave substrate, a Rohacell microwave substrate, a GaAs microwave substrate, or a ceramics microwave substrate. The microstrip reflectarray antenna of the present invention can comprise a plurality of supporting units composed of any kind of material, preferably the supporting units are composed of a material such as insulating material. The distance between the reflecting plate to the ground plate of the microstrip reflectarray antenna of the present invention is not limited, preferably the distance thereinbetween is in the range of 4 mm and 10 mm. The microstrip reflectarray antenna of the present invention can comprise a plurality of microstrip antenna units composed of any kind of material, preferably, the microstrip antenna units are composed of a material such as copper, aluminum, or gold. The shape of the outer ring of the microstrip antenna units of the microstrip reflectarray antenna of the present invention is not limited, preferably the shape of the outer ring is circular, elliptical, square, or polygonal. The first ratio relationship of the second diameter of the inner ring to the first diameter of the outer ring of the same microstrip antenna units of the microstrip reflectarray antenna of the present invention is not limited; preferably the first ratio relationship is in the range of 0.4 and 0.8. The outer ring of the microstrip antenna units of the microstrip reflectarray antenna of the present invention can comprise any number of the first slots; preferably the number of the first slots is between 2 and 4. The inner ring of the microstrip antenna units of the microstrip reflectarray antenna of the present invention can comprise any number of the second slots; preferably the number of the second slots is between 2 and 4.

Other objects, advantages, and novel features of the invention will become more apparent from the following detailed description when taken in conjunction with the accompanying drawings.

DETAILED DESCRIPTION OF THE PREFERRED EMBODIMENT

Figure 2A:
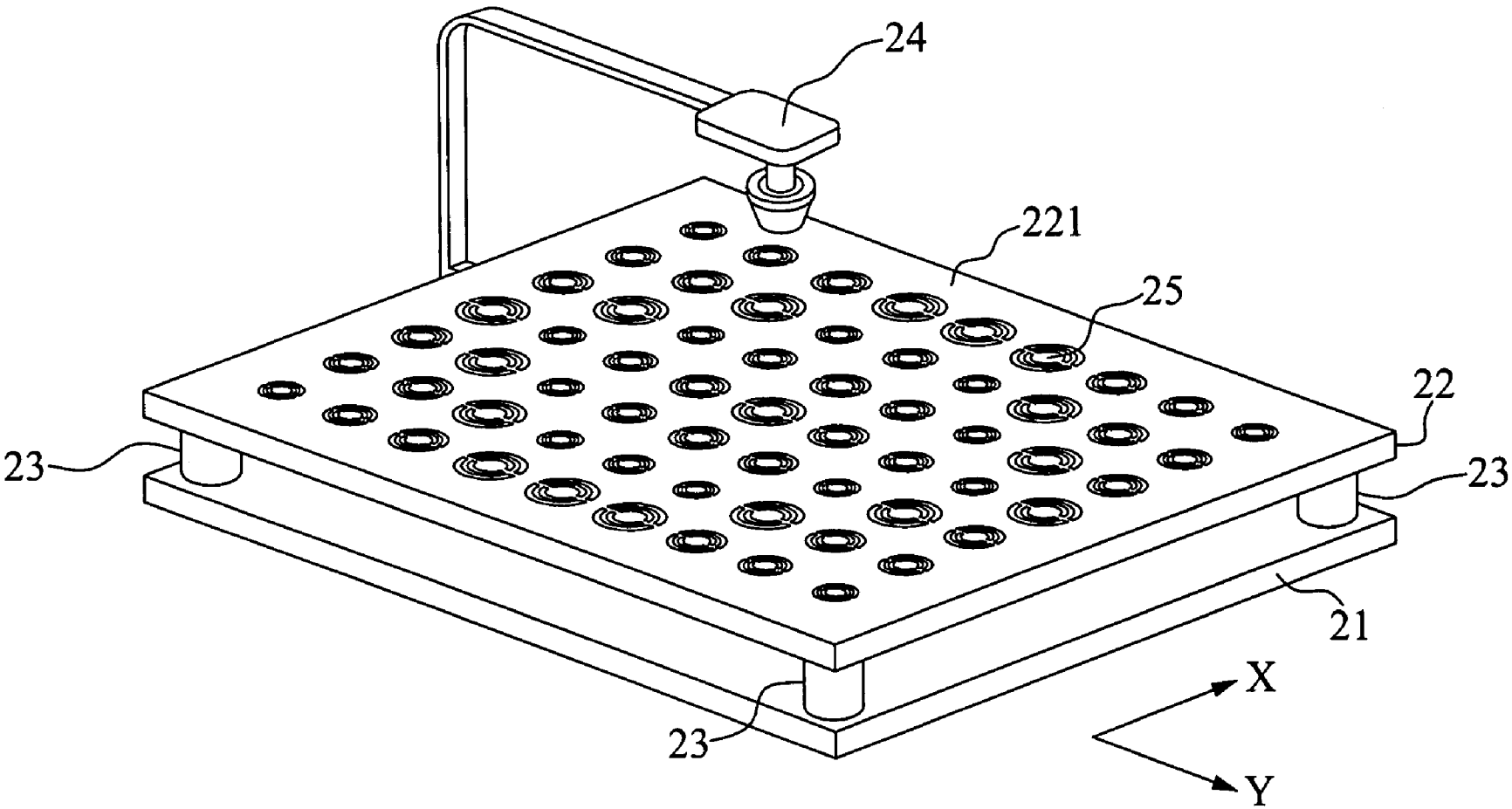
FIG. 2A shows a schematic diagram of the microstrip reflectarray antenna according to the first preferred embodiment of the present invention.
Figure 2B:
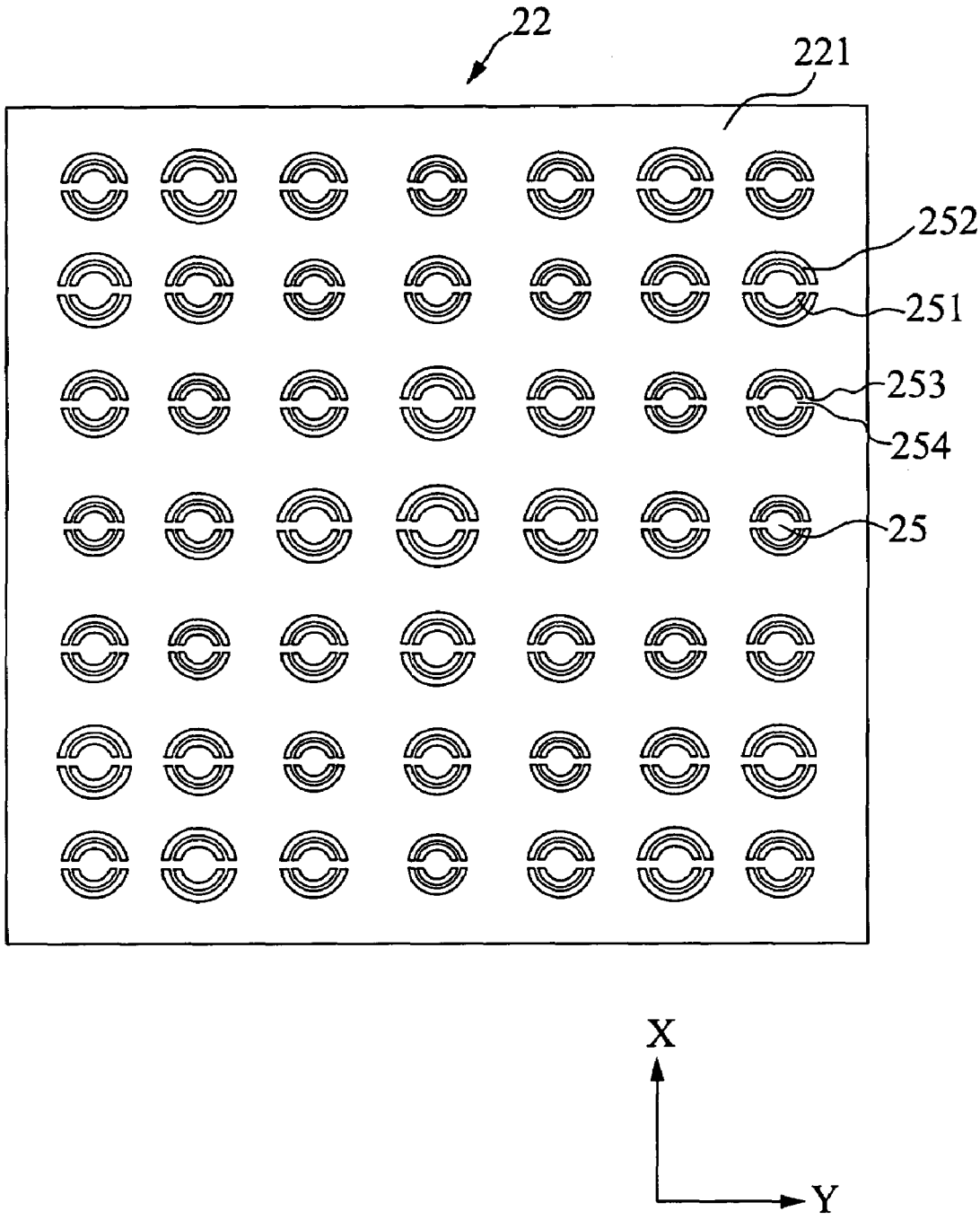
FIG. 2B shows a schematic diagram of the upper surface of the reflecting plate of the microstrip reflectarray antenna according to the first preferred embodiment of the present invention.

FIG. 2A shows a schematic diagram of the microstrip reflectarray antenna according to the first preferred embodiment of the present invention. In the present preferred embodiment, the microstrip reflectarray antenna comprises a ground plate 21, a reflecting plate 22, four supporting units 23, and a horn antenna 24. The reflecting plate 22 is supported by the four supporting units 23 being composed of at least one insulating material, and thus a predetermined distance between the reflecting plate 22 and the ground plate 21 being composed of copper is maintained. In the present preferred embodiment, the distance between the reflecting plate 22 and the ground plate 21 is about 6 mm. But, as in different operation environments, the distance between the reflecting plate 22 and the ground plate 21 can be varied by adjusting the length of the four supporting units 23. With reference to FIG. 2B, the microstrip reflectarray antenna according to the first preferred embodiment of the present invention comprises a plurality of microstrip antenna units 25 locating on the upper surface 221 of the reflecting plate 22, and each of the microstrip antenna units 25 has an inner ring 251 and an outer ring 252.

FIG. 2B shows a schematic diagram of the upper surface of the reflecting plate of the microstrip reflectarray antenna according to the first preferred embodiment of the present invention. In the present preferred embodiment, the size of each of the microstrip antenna units 25 (the length of the first diameter of the outer ring 252) corresponds to the location thereof on the upper surface of the reflecting plate of the microstrip reflectarray antenna of the present invention. Therefore, as the microstrip reflectarray antenna in its "transmitting state", the reflecting plate 22 can correctly reflect the high frequency signal from the horn antenna 24 to the ambient space; and as the microstrip reflectarray antenna is in its "receiving state", the reflecting plate 22 can also correctly reflect the high frequency signal from the ambient space to the horn antenna 24.

In the present preferred embodiment, the microstrip antenna unit 25 locating on the upper surface 221 of the reflecting plate 22 of the microstrip reflectarray antenna further comprises some characteristics, as described as below:

1. There is a predetermined ratio relationship between the length of the first diameter of the outer ring 252 and the length of the second diameter of the inner ring 251 of the same microstrip antenna unit, and the ratio relationship is applied to all of the microstrip antenna units 25 locating on the upper surface 221 of the reflecting plate 22 of the microstrip reflectarray antenna of the present invention. Besides, the ratio relationship can be varied for the different operation environments of the microstrip reflectarray antenna of the present invention. Generally speaking, the ratio of the second diameter of the inner ring 251 to the first diameter of the outer ring 252 of the same microstrip antenna unit 25 is preferably in the range of 0.4 and 0.8. In the present preferred embodiment, the ratio of the second diameter of the inner ring 251 to the first diameter of the outer ring 252 of the same microstrip antenna unit 25 is about 0.6.

2. In one of the microstrip antenna units 25, the outer ring 252 has two first slots 253 at one direction and the inner ring 251 of the same microstrip antenna unit also has two second slots 254 at the same direction (such as the Y direction of FIG. 2B). Thus, both the outer ring 252 and the inner ring 251 of the same microstrip antenna unit are divided equally into two portions.

3. In one of the microstrip antenna units 25, the outer ring 252 and the inner ring 251 both have the same width. In the present preferred embodiment, the width of the outer ring 252 and the width of the inner ring 251 of each of the microstrip antenna units 25 are both about 4 mm.

Figure 1A:
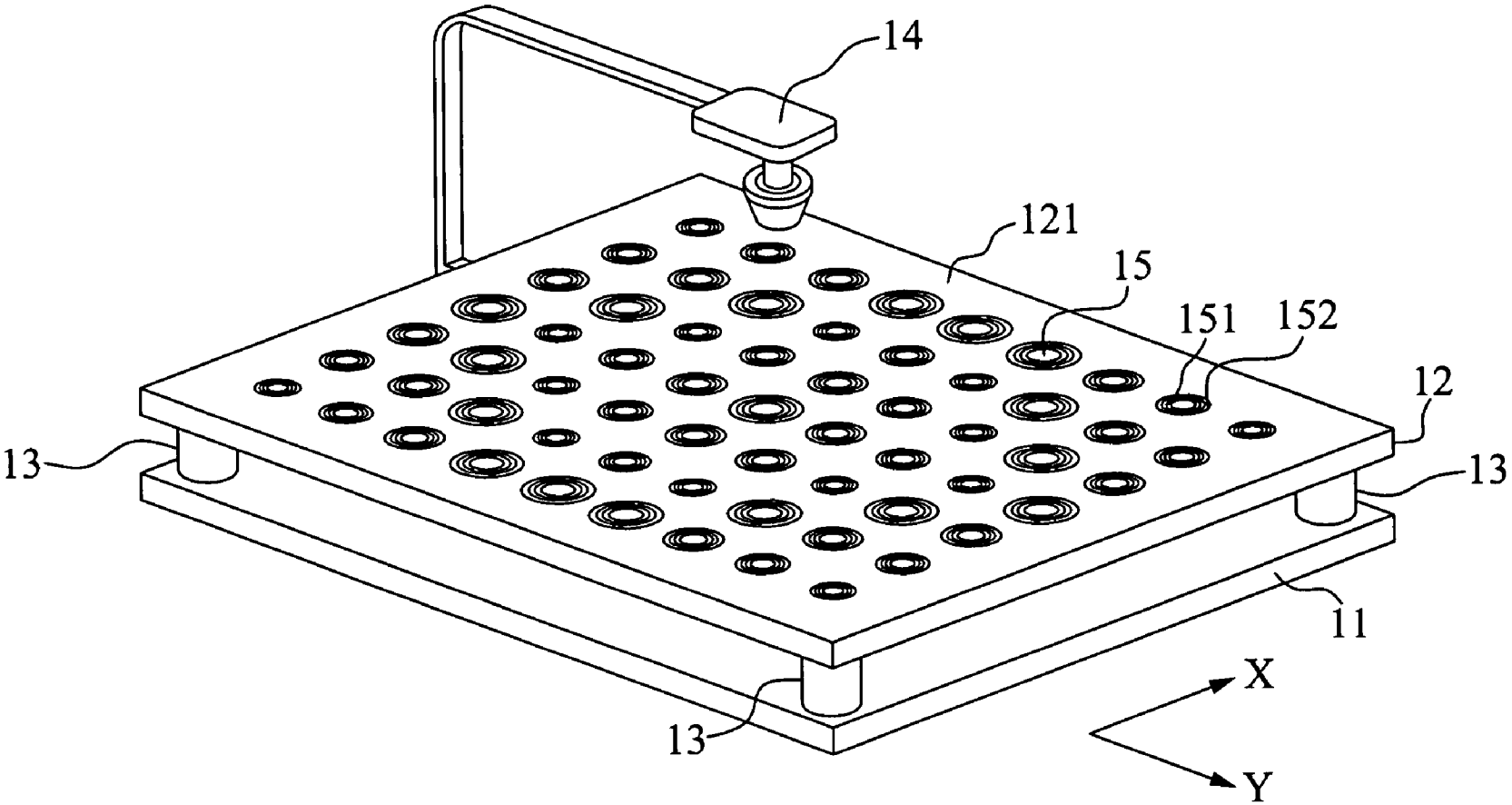
FIG.1A PRIOR ART
FIG. 1A shows a schematic diagram of the microstrip reflectarray antenna of the prior art.

In addition, by presenting the results of the IE3D software simulation and the measurement of both the microstrip reflectarray antenna of the prior art (as shown in FIG. 1A) and the microstrip reflectarray antenna according to first preferred embodiment of the present invention (as shown in FIG. 2A) as described in the following, the lower cross polarization level characteristic of the microstrip reflectarray antenna according to first preferred embodiment of the present invention will be verified. As a result, by using the microstrip reflectarray antenna of the present invention, the available channel number of the satellite communication system will be increased significantly.

Besides, prior to the execution of the IE3D software simulation and the measurement, some limitations must be set. These limitations are described below:

1. The plane wave transmitted from the horn antenna to the reflecting plate is polarized, and the polarization direction of the plane wave is parallel to the Y direction of the FIG. 1A, FIG. 2A, and FIG. 2B. Besides, the cross polarization level (XPL) of the polarized signal at the bore sight angle is about 30 dBi.

2. The reflecting plate is composed of an FR-4 microwave substrate, the size of which is about 24 cm by 24 cm, and the thickness of the reflecting plate is about 0.8 mm.

3. The distance between the reflecting plate and the ground plate is about 6 mm.

4. There are 256 microstrip antenna units locating on the upper surface of the reflecting plate, wherein every two adjacent microstrip antenna units are separated by a pitch of 1.5 cm. Each of the microstrip antenna units comprises an inner ring and an outer ring, respectively. The thickness of the inner ring and the outer ring are both about 0.4 mm. Moreover, in all 256 microstrip antenna units, the length of the second diameter of the inner ring is 0.6 times the length of the first diameter of the outer ring.

5. In the microstrip reflectarray antenna of the prior art, each of the microstrip antenna units does not have any slot in the inner ring, nor outer ring. Besides, the inner ring and the outer ring are concentric.

6. In the microstrip antenna units of the microstrip reflectarray antenna according to the first preferred embodiment of the present invention, the outer ring has two first slots at one direction, while the inner ring also has two second slots at the same direction (such as the Y direction of FIG. 2B). Besides, the widths of the two first slots and the two second slots are about 0.4 mm.

Figure 1B:
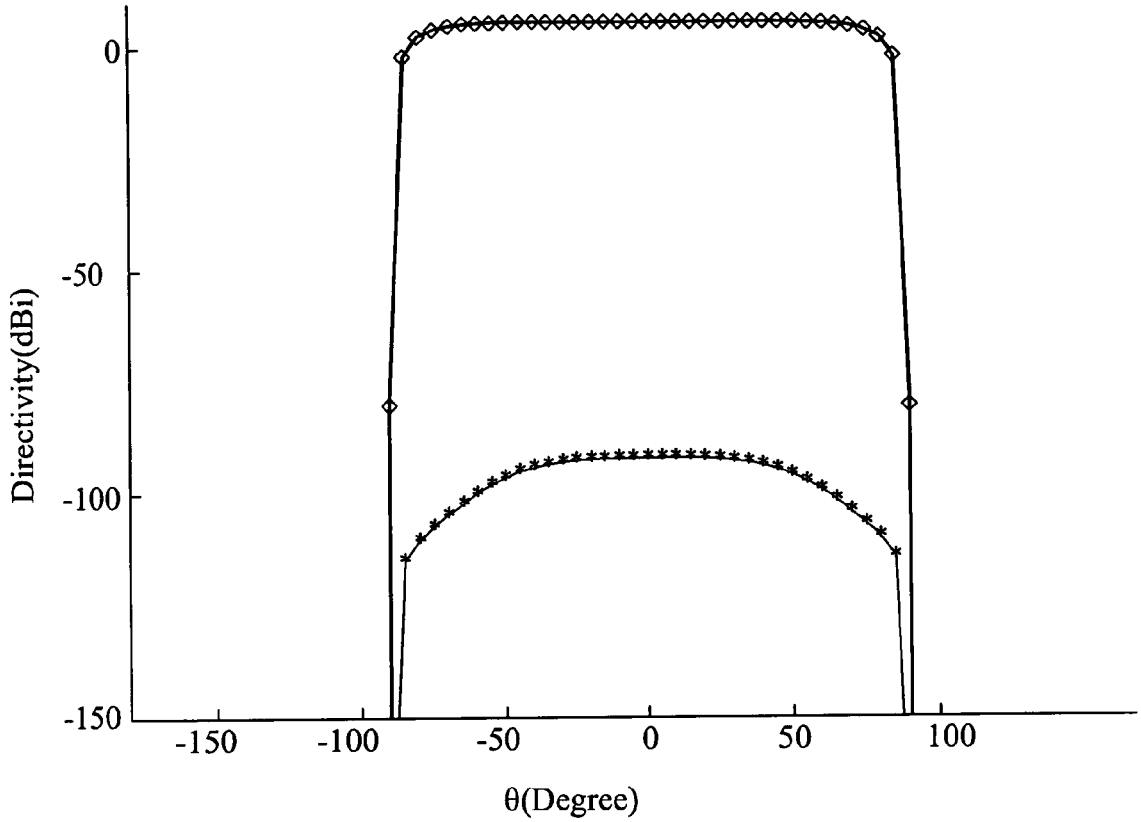
FIG.1B PRIOR ART
FIG. 1B shows the IE3D software simulation result of the plane wave scattering field of the microstrip reflectarray antenna of the prior art.
Figure 3A:
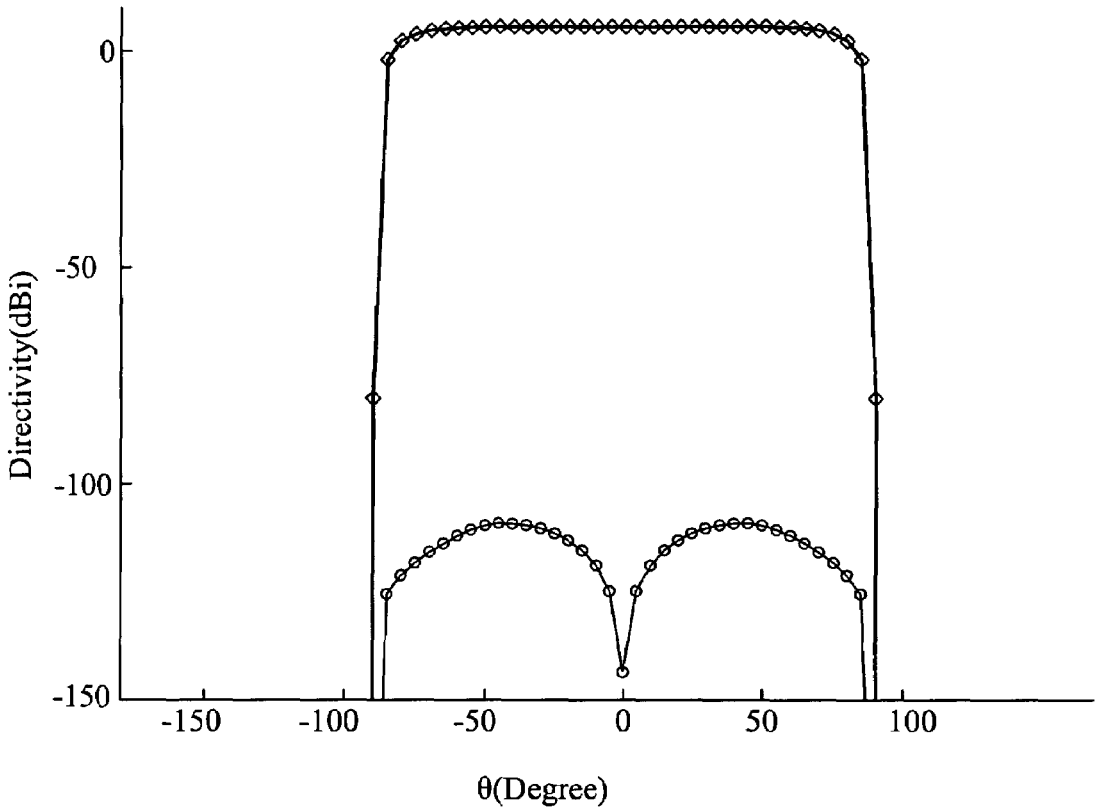
FIG. 3A shows the simulation result of the plane wave scattering field of the microstrip reflectarray antenna according to the first preferred embodiment of the present invention.

The results of the completed IE3D software simulation are shown in FIG. 1B and FIG. 3A. FIG. 1B indicates the plane wave scattering field of the microstrip reflectarray antenna of the prior art. FIG. 3A shows the simulation result of the plane wave scattering field of the microstrip reflectarray antenna according to the first preferred embodiment of the present invention. Furthermore, FIG. 3B shows a schematic diagram resulting from the combination of FIG. 1B and FIG. 3A, for easy identification of the difference between these two figures.

Figure 3B:
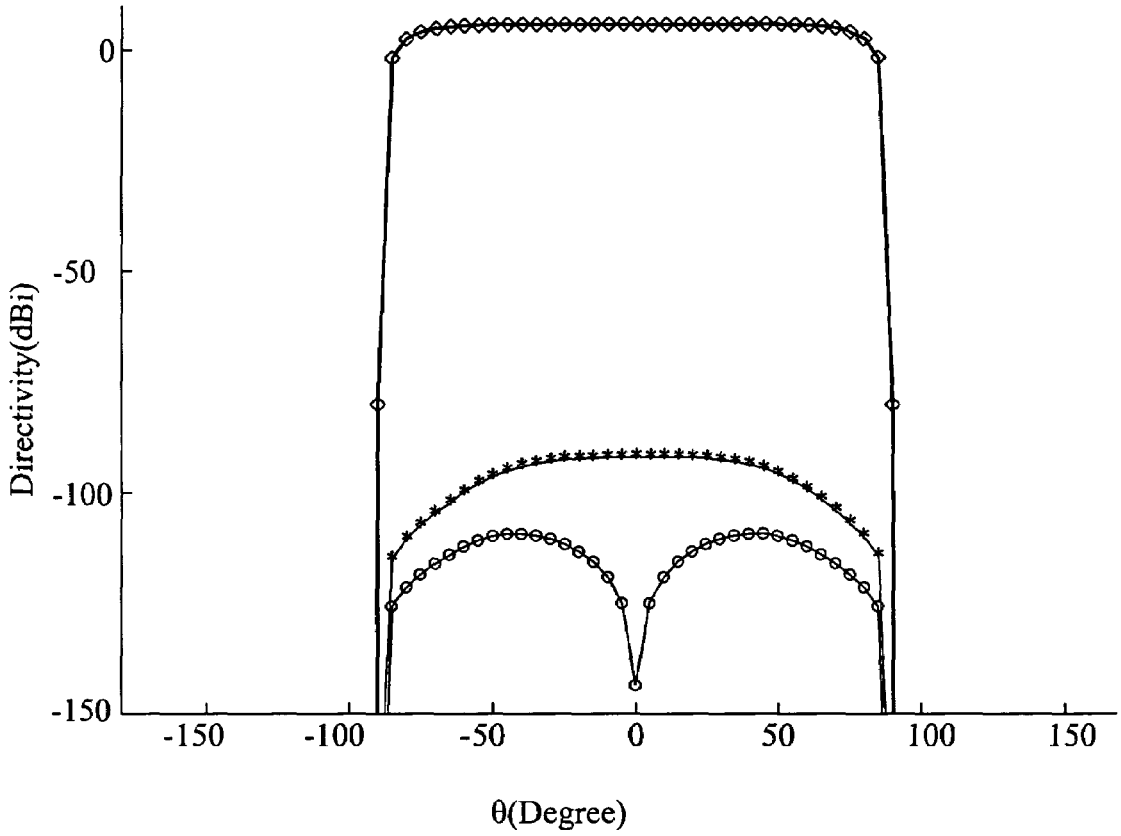
FIG. 3B shows a schematic diagram resulting from the combination of FIG. 1B and FIG. 3A.

With reference to FIG. 3B, the plane wave scattering field of the two high frequency signals reflected by the microstrip reflectarray antennas in the Y-polarization direction are substantially equivalent in all angles, and there is no obvious difference between the two curves representing the two high frequency signals in the operation frequency range of the two microstrip reflectarray antennas (from 9 GHz to 12 GHz), which are shown by "◇" and "-" in FIG. 3B, respectively. Moreover, since the signals transmitted by the horn antennas of the two microstrip reflectarray antennas to their corresponding reflecting plates are Y-polarized high frequency signals, the aforesaid two substantially equivalent curves indicate that these two microstrip reflectarray antennas have similar co-polarization level in all angles(θ).

Referring to FIG. 3B again, as shown in the lower half of the figure, the plane wave scattering fields of the two high frequency signals reflected by the two microstrip reflectarray antennas in the X-polarization direction are significantly different from each other in all angles. Besides, the curve representing the high frequency signal of the microstrip reflectarray antenna according to the first preferred embodiment of the present invention (as shown by the "○" in FIG. 3B) is significantly lower than the curve representing the high frequency signal of the microstrip reflectarray antenna of the prior art (shown by the "*" in FIG. 3B). Moreover, since the signals transmitted by the horn antennas of the two microstrip reflectarray antennas to their corresponding reflecting plates are Y-polarized high frequency signals, the aforesaid two curves indicate that the cross polarization level (XPL) of the microstrip reflectarray antenna according to the first preferred embodiment of the present invention is lower than the cross polarization level (XPL) of the microstrip reflectarray antenna of the prior art in all angles (θ).

Figure 4:
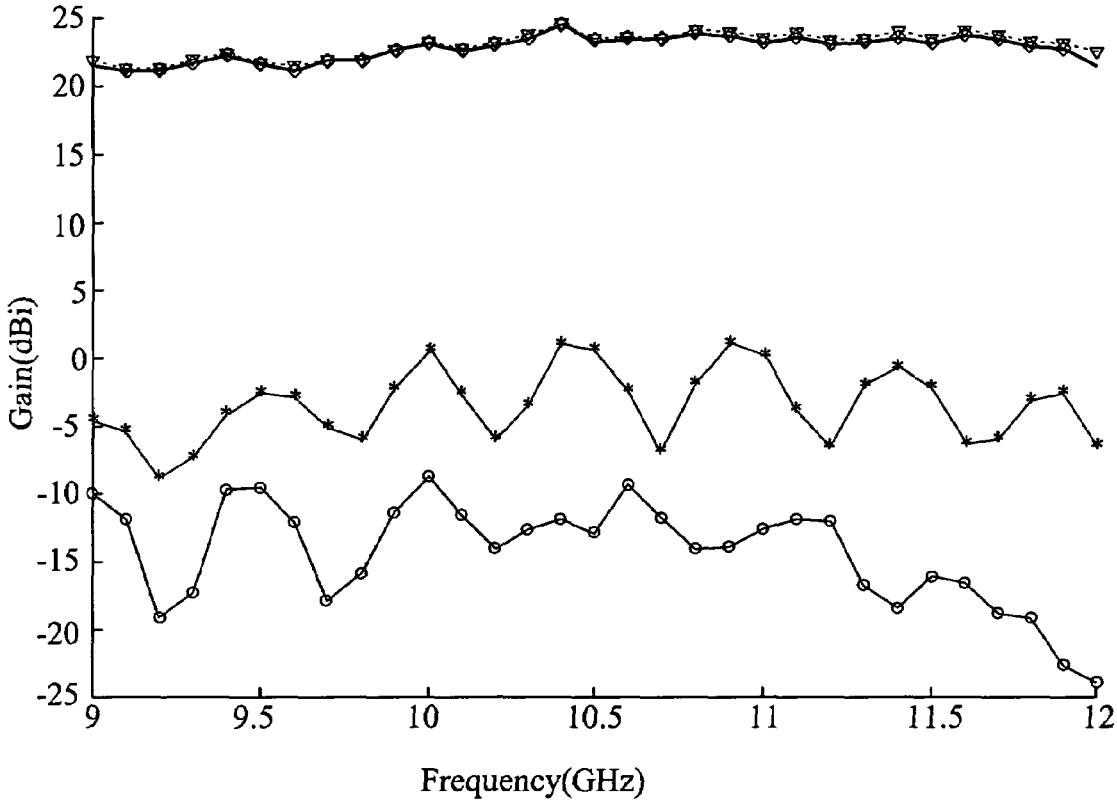
FIG. 4 shows a schematic diagram of the measurement result of both the bore-sight co-polarized radiation gain and the cross polarized radiation gain of the microstrip reflectarray antenna of the prior art and those of the microstrip reflectarray antenna according to the first preferred embodiment of the present invention, wherein the operating frequencies of the two microstrip reflectarray antennas both range from 9 GHz to 12 GHz.

FIG. 4 shows a schematic diagram of the measurement result of both the bore-sight co-polarized radiation gain and the cross polarized radiation gain of the microstrip reflectarray antenna of the prior art and those of the microstrip reflectarray antenna according to the first preferred embodiment of the present invention, wherein the operating frequencies of the two microstrip reflectarray antennas both range from 9 GHz to 12 GHz. As shown in the figure, there is no obvious difference between the two curves representing the bore sight co-polarization gains of the two microstrip reflectarray antennas, which are respectively shown by the "∇" and "- " in FIG. 4. Therefore, the bore sight co-polarization gains of these two microstrip reflectarray antennas are substantially equivalent within the whole operation frequency range (from 9 GHz to 12 GHz).

Referring to FIG. 4 again, as shown in the lower half of the figure, the curve representing the cross-polarized gain of the microstrip reflectarray antenna according to the present preferred embodiment of the present invention (as shown by the "○" in FIG. 4) is totally different from and obviously lower than the curve representing the cross-polarized gain of the microstrip reflectarray antenna of the prior art (as shown by the "*" in FIG. 4) within the whole operation frequency range (from 9 GHz to 12 GHz). Therefore, the cross-polarized gain of the microstrip reflectarray antenna according to the present preferred embodiment of the present invention is obviously lower than the cross-polarized gain of the microstrip reflectarray antenna of the prior art.

Figure 5:
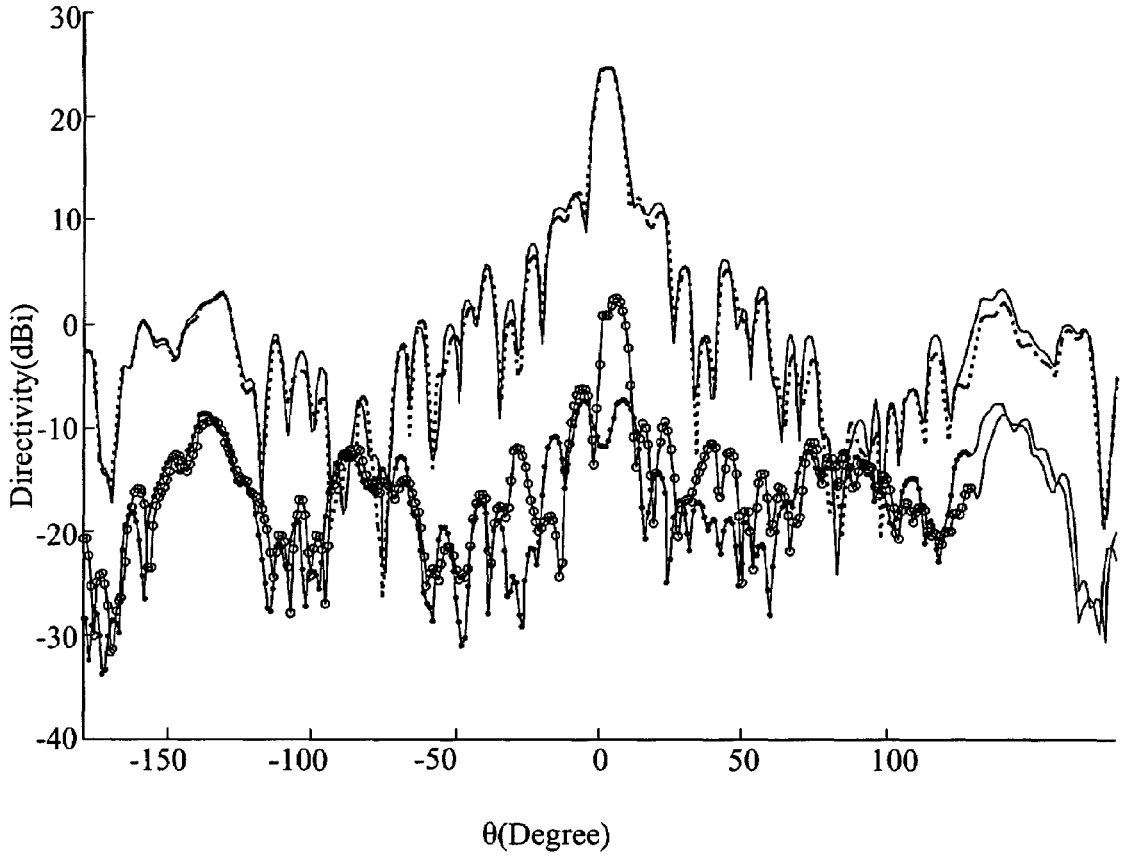
FIG. 5 shows a schematic of the measurement result of both the co-polarization radiation pattern in H-plane and the cross-polarization radiation pattern in H-plane of the microstrip reflectarray antenna of the prior art and those of the microstrip reflectarray antenna according to the first preferred embodiment of the present invention, as the two microstrip reflectarray antennas both operate at 10.4 GHz.

FIG. 5 shows a schematic diagram of the measurement result of both the co-polarization radiation pattern in H-plane and the cross-polarization radiation pattern in H-plane of the microstrip reflectarray antenna of the prior art and those of the microstrip reflectarray antenna according to the first preferred embodiment of the present invention, as the two microstrip reflectarray antennas both operate at 10.4 GHz. As shown in the figure, there is no obvious difference between the two curves representing the co-polarization radiation pattern of the two microstrip reflectarray antennas in all angles, which are respectively shown by "-" and "-- " in FIG. 5. Therefore, the co-polarization radiation patterns of these two microstrip reflectarray antennas are substantially equivalent in all angles (θ).

Referring to FIG. 5 again, as shown in the lower half of the figure, the curves representing the cross-polarization radiation patterns of the two microstrip reflectarray antennas are different from each other in all angles (θ), wherein the curve representing the cross-polarization radiation pattern of the microstrip reflectarray antenna according to the first preferred embodiment of the present invention (as shown by the "●" in FIG. 5) is lower than the curve representing the cross-polarization radiation pattern of the microstrip reflectarray antenna of the prior art (as shown by the "○" in FIG. 5). Therefore, the cross-polarization radiation pattern of the microstrip reflectarray antenna according to the first preferred embodiment of the present invention is significantly lower than the cross-polarization radiation pattern of the microstrip reflectarray antenna of the prior art.

In the present preferred embodiment, the second diameter of the inner ring is 0.6 times the first diameter of the outer ring of each of the microstrip antenna units locating on the upper surface of the microstrip reflectarray antenna according to the first preferred embodiment of the present invention, but preferably the ratio of the second diameter of the inner ring to the first diameter of the outer ring is in the range of 0.4 and 0.8. Furthermore, once the ratio is changed, the cross polarization level of the microstrip reflectarray antenna is also changed accordingly. Taking the microstrip reflectarray antenna according to the first preferred embodiment of the present invention as an example, when the ratio is 0.6, the cross polarization level of the microstrip reflectarray antenna is about 36 dB. But when the ratio is changed from 0.6 to 0.8, the cross polarization level of the microstrip reflectarray antenna will decline to 20 dB as a result, that is, more noise (such as the signal with different polarization direction) will be received by the microstrip reflectarray antenna according to the first preferred embodiment of the present invention.

Figure 6:
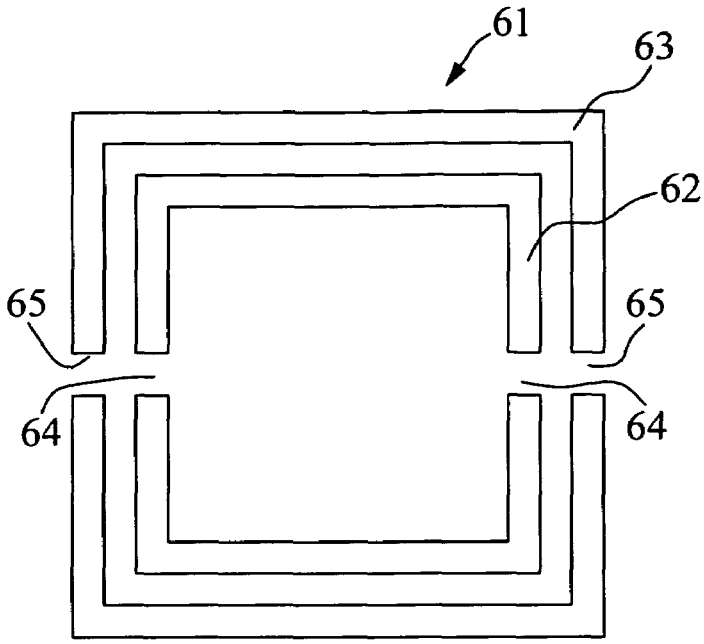
FIG. 6 shows a schematic diagram of the upper surface of the reflecting plate of the microstrip reflectarray antenna according to the second preferred embodiment of the present invention.

FIG. 6 shows a schematic diagram of the upper surface of the reflecting plate of the microstrip reflectarray antenna according to the second preferred embodiment of the present invention. In the present preferred embodiment, each of the microstrip antenna units 61 locating on the upper surface of the reflecting plate has a square inner ring 62 and a square outer ring 63. Besides, in each of microstrip antenna units, the geometry center of the inner ring 62 overlaps the geometry center of the outer ring 63. In addition, the outer ring 63 has two first slots 64 and the inner ring 62 has two second slots 65, respectively. Therefore, the outer ring 63 and inner ring 62 of the same microstrip antenna unit are both divided into two equal portions. Moreover, the size of the outer ring 63 corresponds to the location of the outer ring 63 on the upper surface of the reflecting plate of the microstrip reflectarray antenna according to the second preferred embodiment of the invention.

Figure 7:
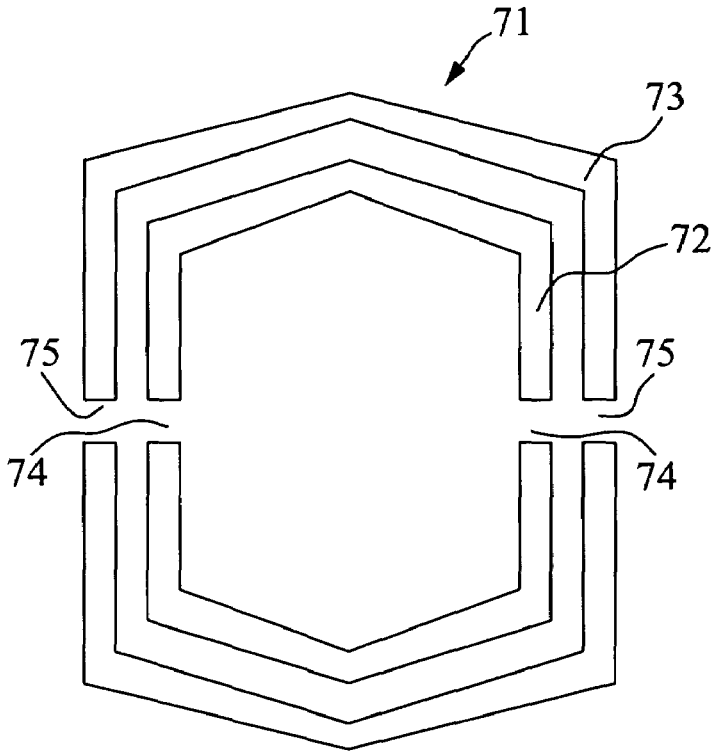
FIG. 7 shows a schematic diagram of the upper surface of the reflecting plate of the microstrip reflectarray antenna according to the third preferred embodiment of the present invention.

FIG. 7 shows a schematic diagram of the upper surface of the reflecting plate of the microstrip reflectarray antenna according to the third preferred embodiment of the present invention. In this present preferred embodiment, each of the microstrip antenna units 71 locating on the upper surface of the reflecting plate has a hexagonal inner ring 72 and a hexagonal outer ring 73. Besides, in each of microstrip antenna units, the geometry center of the inner ring 72 overlaps the geometric center of the outer ring 73. In addition, the outer ring 73 has two first slots 74 and the inner ring 72 has two second slots 75, respectively. Therefore, the outer ring 73 and inner ring 72 of the same microstrip antenna unit are both divided into two equal portions. Moreover, the size of the outer ring 73 corresponds to the location of the outer ring 73 on the upper surface of the reflecting plate of the microstrip reflectarray antenna according to the third preferred embodiment of the invention.

In summary, as the microstrip antenna units of the microstrip reflectarray antenna of the present invention each consists of an outer ring having two first slots, and an inner ring having two second slots, wherein the connecting line connecting the two first slots (not shown in the figure) is parallel to the other connecting line connecting the two second slots (not shown in the figure), the microstrip antenna units of the microstrip reflectarray antenna of the present invention can prevent the current induced by a high frequency signal having a polarization direction perpendicular to the connecting line of the two first slots from flowing on the microstrip antenna units when the microstrip reflectarray antenna of the present invention is in its "receiving state". As a result, the microstrip reflectarray antenna of the present invention can only receive the high frequency signals having the polarization direction parallel to the connecting line of the two first slots of the microstrip antenna units, and the cross polarization level of the microstrip reflectarray antenna is further reduced. Hence, by using the microstrip reflectarray antenna of the present invention, a satellite communication system can use one frequency channel to transmit two or more signals with different polarization directions at the same time. Thus, the capacity of the satellite communication system is enlarged, and the reception quality thereof is also improved.

Although the present invention has been explained in relation to its preferred embodiment, it is to be understood that many other possible modifications and variations can be made without departing from the scope of the invention as hereinafter claimed.

What is claimed is:

1. A microstrip reflectarray antenna for transmitting and receiving a high frequency signal, comprising:

a ground plate;

a reflecting plate with an upper surface, and a plurality of microstrip antenna units locating on the upper surface; each of the microstrip antenna units consisting of an inner ring and an outer ring;

a plurality of supporting units for supporting the reflecting plate above the ground plate, so as to maintain a predetermined distance between the reflecting plate and the ground plate; and a signal transmitting unit locating above the reflecting plate for transmitting and receiving the high frequency signal;

wherein, the size of the outer ring corresponds to the location of the outer ring on the upper surface of the reflecting plate; each of the microstrip antenna units comprises an outer ring with a first diameter and an inner ring with a second diameter, and there is a first ratio relationship between the first diameter of the outer ring and the second diameter of the inner ring of the same microstrip antenna unit; each of the outer rings has at least one first slot, and each of the inner rings has at least one second slot, and wherein the outer ring of each of the microstrip antenna units has two first slots.

2. The microstrip reflectarray antenna as claimed in claim 1, wherein the signal transmitting unit is a horn antenna.

3. The microstrip reflectarray antenna as claimed in claim 1, wherein the frequency of the high frequency ranges from 9 GHz to 12 GHz.

4. The micro strip reflectarray antenna as claimed in claim 1, wherein the ground plate is a copper plate.

5. The microstrip reflectarray antenna as claimed in claim 1, wherein the reflecting plate is an FR-4 microwave substrate.

6. The micro strip reflectarray antenna as claimed in claim 1, wherein the plurality of supporting unit is composed of an insulating material

7. The microstrip reflectarray antenna as claimed in claim 1, wherein the distance between the ground plate and the reflecting plate ranges from 4 mm to 10 mm.

8. The micro strip reflectarray antenna as claimed in claim 1, wherein the distance between the ground plate and the reflecting plate is adjusted by changing the length of the plurality of the supporting units.

9. The microstrip reflectarray antenna as claimed in claim 1, wherein the inner ring of each of the micro strip antenna units is a circular ring.

10. The microstrip reflectarray antenna as claimed in claim 1, wherein the outer ring of each of the microstrip antenna units is a circular ring.

11. The micro strip reflectarray antenna as claimed in claim 1, wherein the inner ring and the outer ring of each of the microstrip antenna units are concentric rings.

12. The microstrip reflectarray antenna as claimed in claim 1, wherein in each of the microstrip antenna units, the ratio of the second diameter of the inner ring to the first diameter of the outer ring ranges from 0.4 to 0.8.

13. The microstrip reflectarray antenna as claimed in claim 1, wherein in each of the microstrip antenna units, the width of the inner ring is equal to the width of the outer ring.

14. The microstrip reflectarray antenna as claimed in claim 1, wherein the two first slots are located at two opposing ends of the first diameter of the outer ring.

15. The microstrip reflectarray antenna as claimed in claim 14, wherein the inner ring of each of the microstrip antenna units has two second slots.

16. The microstrip reflectarray antenna as claimed in claim 15, wherein the two second slots are respectively located at two ends of the second diameter of the inner ring.

17. The microstrip reflectarray antenna as claimed in claim 16, wherein the first diameter of the outer ring overlaps the second diameter of the inner ring.

* * * * *